US007658416B1

(12) United States Patent
Hinman

(10) Patent No.: US 7,658,416 B1
(45) Date of Patent: Feb. 9, 2010

(54) ALBUM SYSTEM AND COMPONENTS THEREOF

(76) Inventor: Tracie Hinman, 3 Meadowbrook Rd., Spencer, MA (US) 01562

( * ) Notice: Subject to any disclaimer, the term of this patent is extended or adjusted under 35 U.S.C. 154(b) by 494 days.

(21) Appl. No.: 11/162,335

(22) Filed: Sep. 7, 2005

(51) Int. Cl.
*B42D 3/10* (2006.01)

(52) U.S. Cl. ..... 281/36; 281/38; 206/311

(58) Field of Classification Search ..... 281/3.1, 281/4, 15.1, 19.1, 19.2, 21.1, 22, 36, 38; 402/8, 9, 12–14, 60, 79; 206/232, 311, 312, 206/424

See application file for complete search history.

(56) References Cited

U.S. PATENT DOCUMENTS

| | | | | |
|---|---|---|---|---|
| 1,009,071 | A * | 11/1911 | Jensen | 281/15.1 |
| 2,167,363 | A * | 7/1939 | Hoenigsberger | 402/60 |
| 4,236,559 | A * | 12/1980 | Archbold | 224/610 |
| 5,087,145 | A | 2/1992 | Cooley | |
| 5,120,149 | A * | 6/1992 | Smith | 402/75 |
| 5,501,326 | A * | 3/1996 | Shuhsiang | 206/307.1 |
| 6,019,539 | A * | 2/2000 | Lynton | 402/79 |
| 6,059,317 | A | 5/2000 | Wiley | |
| 6,168,340 | B1 | 1/2001 | Lehmann et al. | |
| 6,183,158 | B1 | 2/2001 | Lynton | |
| 2002/0197098 | A1* | 12/2002 | Palmer | 402/79 |
| 2003/0193181 | A1* | 10/2003 | Hung | 281/15.1 |
| 2003/0201638 | A1* | 10/2003 | LeMaitre | 281/38 |
| 2004/0071495 | A1* | 4/2004 | Legrand | 402/8 |

FOREIGN PATENT DOCUMENTS

| | | |
|---|---|---|
| DE | 10142919 | 3/2003 |
| FR | 2682322 | 4/1993 |
| FR | 2724595 | 3/1996 |
| FR | 2726507 | 5/1996 |
| JP | 9071077 | 3/1997 |
| JP | 10090872 | 4/1998 |
| JP | 2000127648 | 5/2000 |
| JP | 2003145975 | 5/2003 |

OTHER PUBLICATIONS http://www.thescraprack.com/products.html Accessed Aug. 16, 2005.
http://www.lightimpressionsdirect.com/servlet/OnlineShopping?DSP=50000&IID=20108 Accessed Sep. 29, 2005.
http://www.cropinstyle.com/products/inserts.html Accessed Aug. 16, 2005.
http://store.scrapbook.com/bb-cl62240.html Accessed Aug. 16, 2005.

* cited by examiner

*Primary Examiner*—Dana Ross
*Assistant Examiner*—Pradeep C Battula
(74) *Attorney, Agent, or Firm*—Paul H. Demchick

(57) ABSTRACT

An album system and components thereof. The system is an improved book-like system for use as a photo album, scrapbook or the like. Embodiments include leaves and covers which can be reversibly attached by a hook and loop attachment system and leaves that significantly reduce the accidental spilling of the contents stored for display in such albums. In some embodiments, each rectangular leaf is made from two sheets of polypropylene sealed together on all four edges, there is slit in a single sheet, near (but not at) one edge, and the opposite a region near the opposite edge is surfaced with one component of a hook and loop attachment system.

3 Claims, 13 Drawing Sheets

ALBUM SYSTEM AND COMPONENTS THEREOF

CLARIFICATION ABOUT TERMS

As used herein "display item" refers to any item which is displayed in a book-like system. Display items include, without limitation, scrapbook pages, photographic prints, memorabilia and sales flyers. The plural of "display item" is "display items." Those book-like systems include, without limitation, photo albums, binders for sales materials and scrapbooks.

"Leaf" as used herein refers to a generally flat unit with a page on each side equipped for reversible fastening within a book-like system. In some cases, only one of the two pages of a leaf may be used to house display items. The plural of "leaf" is "leaves."

As used herein, "album cover system" refers to an item or items intended to reversibly accept leaves. Those album cover systems include, among other styles, the conventional ring type binder. Those ring type binders include the widely used three ring binders. As used herein, album cover systems include those which are a single piece and those which comprise a plurality of pieces. The plural of "album cover system" is "album cover systems."

As used herein, a "slit" refers to an essentially straight discontinuity in a material, in which that discontinuity is sufficiently narrow that the opposite edges of the material which are immediately adjacent to the slit are touching each other, or nearly so, when the material is unstressed. The plural of "slit" is "slits."

As used herein, a "securement region" on a leaf refers to that region which is equipped for attachment within an "album cover system." For example, for a leaf equipped for use in a conventional three-ring binder, the attachment region is the region with the holes through which the rings can be passed. The plural of "securement region" is "securement regions."

As used herein, the "spine" of an album cover system is the portion of the album cover system to which the front cover and back covers connect. That spine is on the binding side of the album cover system. Typically, the general orientation of the spine is nearly perpendicular to the general orientation of the front cover when the book-like system is closed. Likewise, typically, the general orientation of the spine is nearly perpendicular to the general orientation of the back cover when the book-like system is closed. The plural of "spine" is "spines."

BACKGROUND OF THE INVENTION

There are book-like systems intended for the display of added items. These include, but are not limited to, photo albums, binders for sales materials and scrapbooks. However, no previously disclosed book-like system intended for the housing of display items has been fully satisfactory for all purposes for which such systems are used.

Many such book-like systems intended for the display of added items include leaves, each of which is made from two rectangular transparent thermoplastic sheets which are fused together near three edges. The fourth edge is left unsealed so that display items can be easily inserted. While items can be easily inserted into such pages, they can also easily fall out of such pages. There have been leaves which tend to prevent the spilling of contents. For example, there are leaves which feature pockets with flaps.

SUMMARY OF THE INVENTION

The invention disclosed here is an album system and the components of that system. One object of certain embodiments of the invention disclosed here is to reduce the risk of accidental spillage of display items. Another object of certain embodiments of the invention is to provide for the convenient insertion and removal of leaves. Yet another object of certain embodiments of the invention is to provide a system that better shields display items from dust and the like. Yet another object of certain embodiments of the invention is to decrease the chances of deformation or tearing of pages possible in systems, such as three ring binder systems, in which the securing occurs in relatively small areas. Certain other objects of the invention disclosed here are revealed below.

DETAILED DESCRIPTION OF EMBODIMENTS OF THE INVENTION

Figure 1:
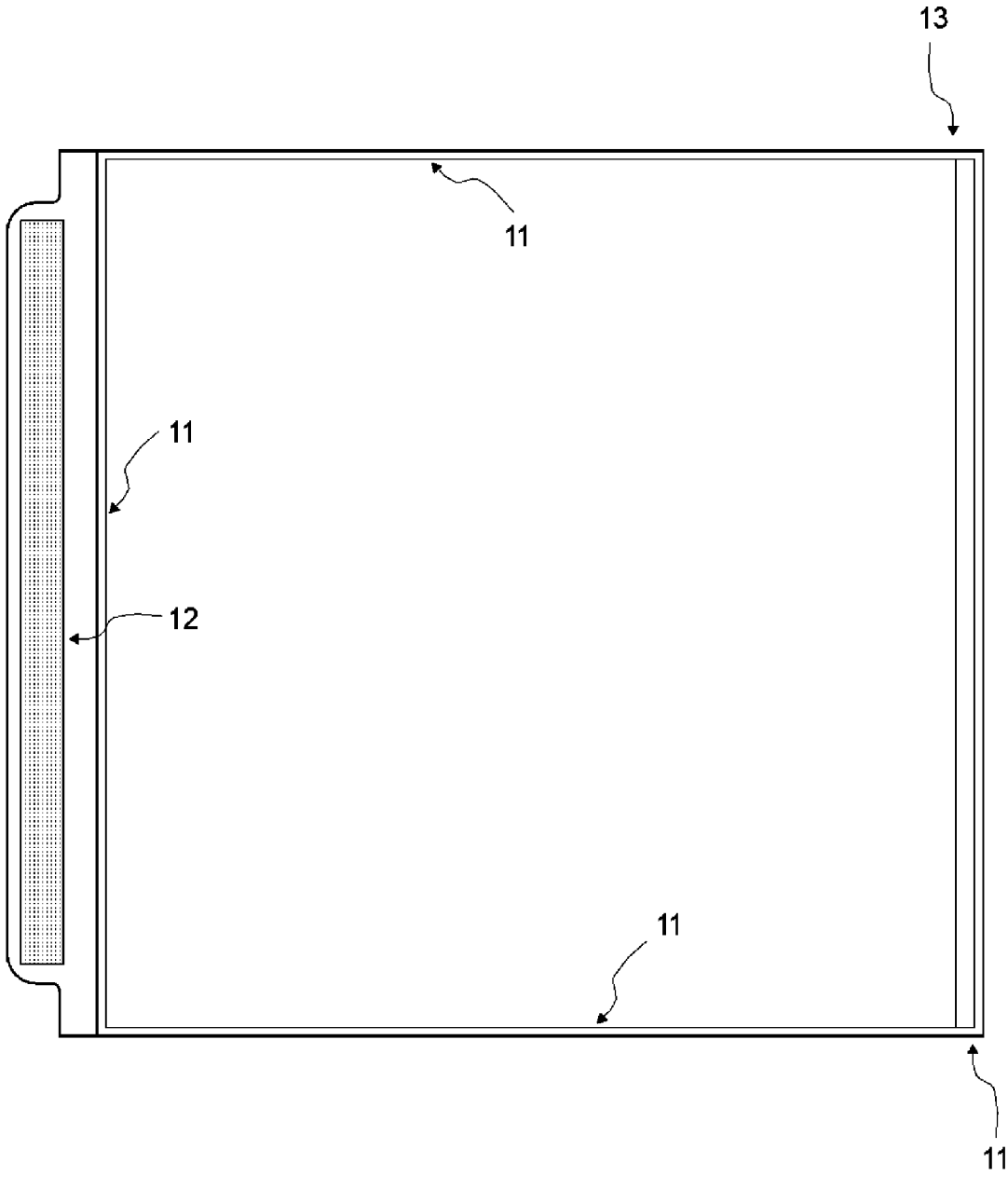
FIG. 1 depicts Embodiment I of the leaf component of the invention.

FIG. 1 depicts Embodiment I of the leaf component of the invention disclosed here. The main body of that embodiment is manufactured from two pieces of polypropylene which are fused together near the edges 11 to form an essentially square pocket approximately 31 cm on each side. A slit 13 is cut in one of the sheets of essentially colorless and transparent 4.5 mil polypropylene. The sheet with the slit is the front sheet as depicted in FIG. 1 (i.e., the sheet that is nearer to the viewer of the figure). That slit extends almost, but not entirely, the span of the sheet. That slit is essentially parallel to two of the edges of the square and approximately 0.8 cm from the nearest line where the two sheets are fused together. The polypropylene is also fused to hold the sheets together in the region shown in FIG. 1 as being generally left of the square. A portion 12 of that region shown in FIG. 1 as being generally left of the square is surfaced with the hook member of a hook and loop attachment system.

Figure 2:
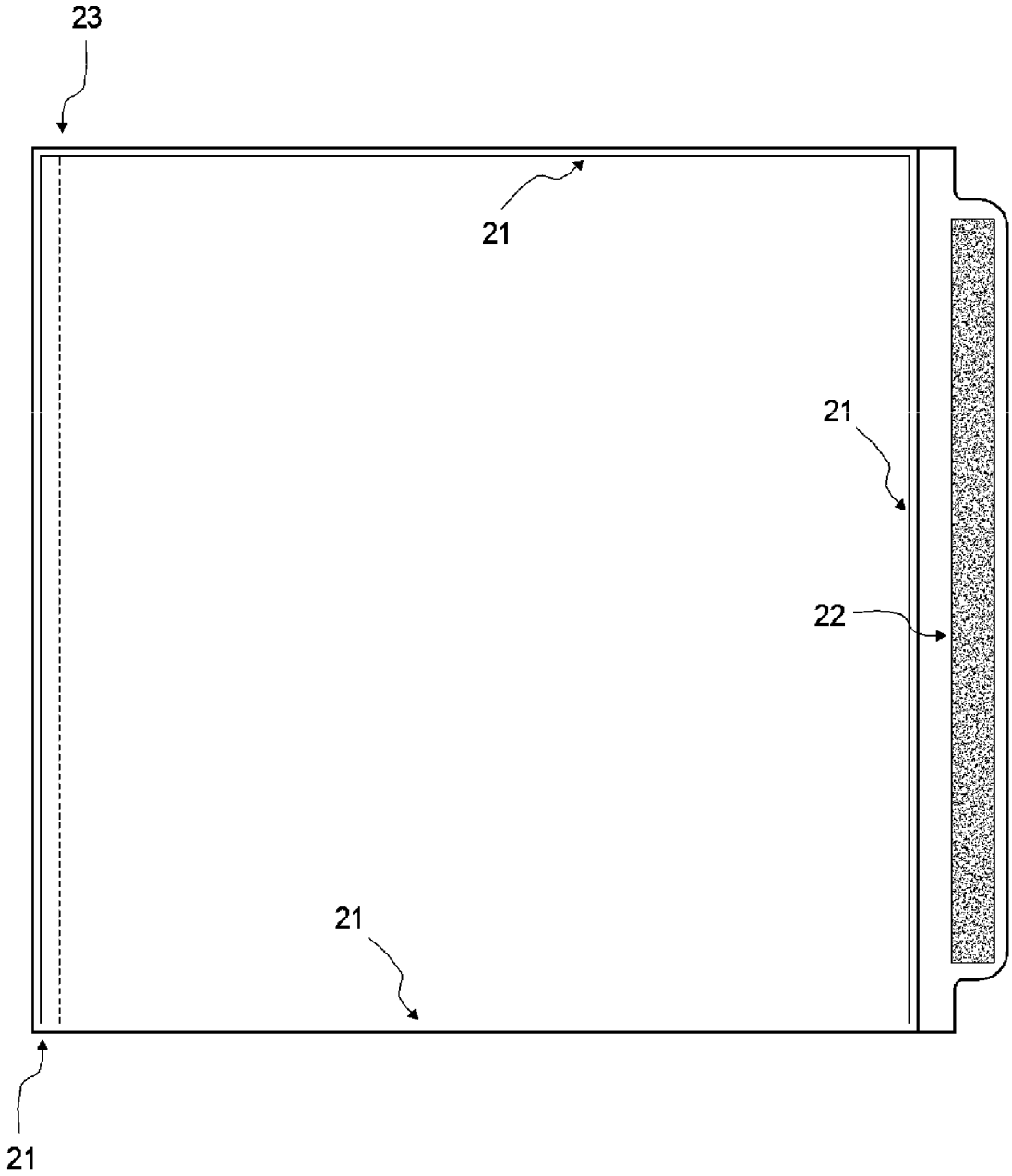
FIG. 2 depicts Embodiment I from the opposite side from that depicted in FIG. 1.

FIG. 2 depicts Embodiment I from the opposite side from that depicted in FIG. 1. A region 22 is surfaced with the loop member of a hook and loop attachment system. The surfaced region is essentially lined up with the region on the other side of the leaf that is surfaced with the hook member of the hook and loop attachment system. The edges 21 of the approximately square envelope are indicated. The slit 23 is on the opposite side of the leaf, but the location of the slit is indicated with a dashed line.

Figure 3:
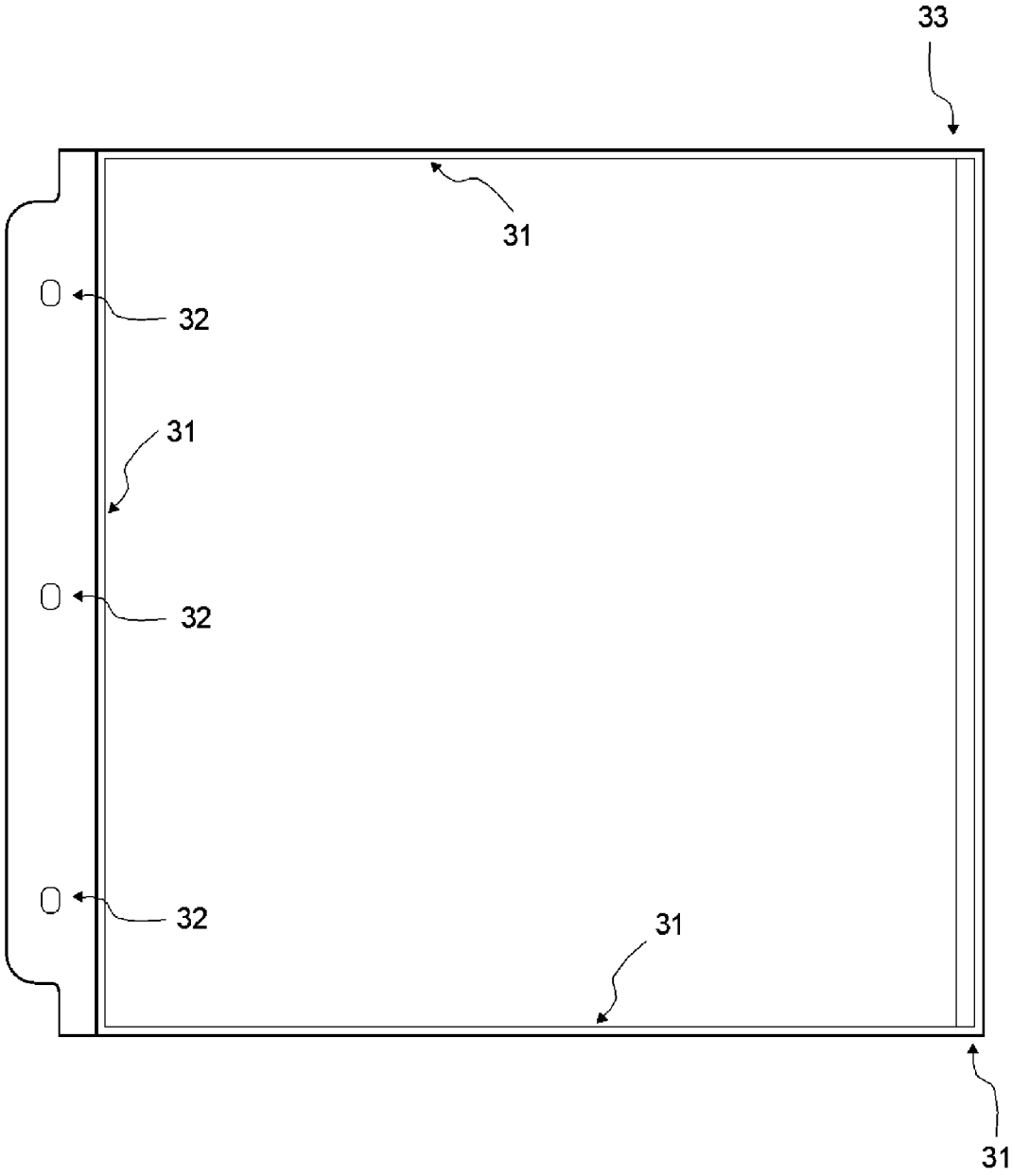
FIG. 3 depicts Embodiment II of the leaf component of the invention.

FIG. 3 depicts Embodiment II of the leaf component of the invention disclosed here. The main body of that embodiment is manufactured from two pieces of essentially colorless and transparent 4.5 mil polypropylene which are fused together near the edges 31 to form an essentially square pocket approximately 31 cm on each side. A slit 33 is cut in one of the sheets of polypropylene. The sheet with the slit is the front sheet as depicted in FIG. 1 (i.e., the sheet that is nearer to the viewer of the figure). That slit extends almost, but not entirely, the span of the sheet. That slit is essentially parallel to two of the edges of the square and approximately 0.8 cm from the nearest line where the two sheets are fused together. The polypropylene is also fused to hold the sheets together in the region shown in FIG. 3 as being generally left of the square. Three holes 32 are cut through the leaf.

Figure 4:
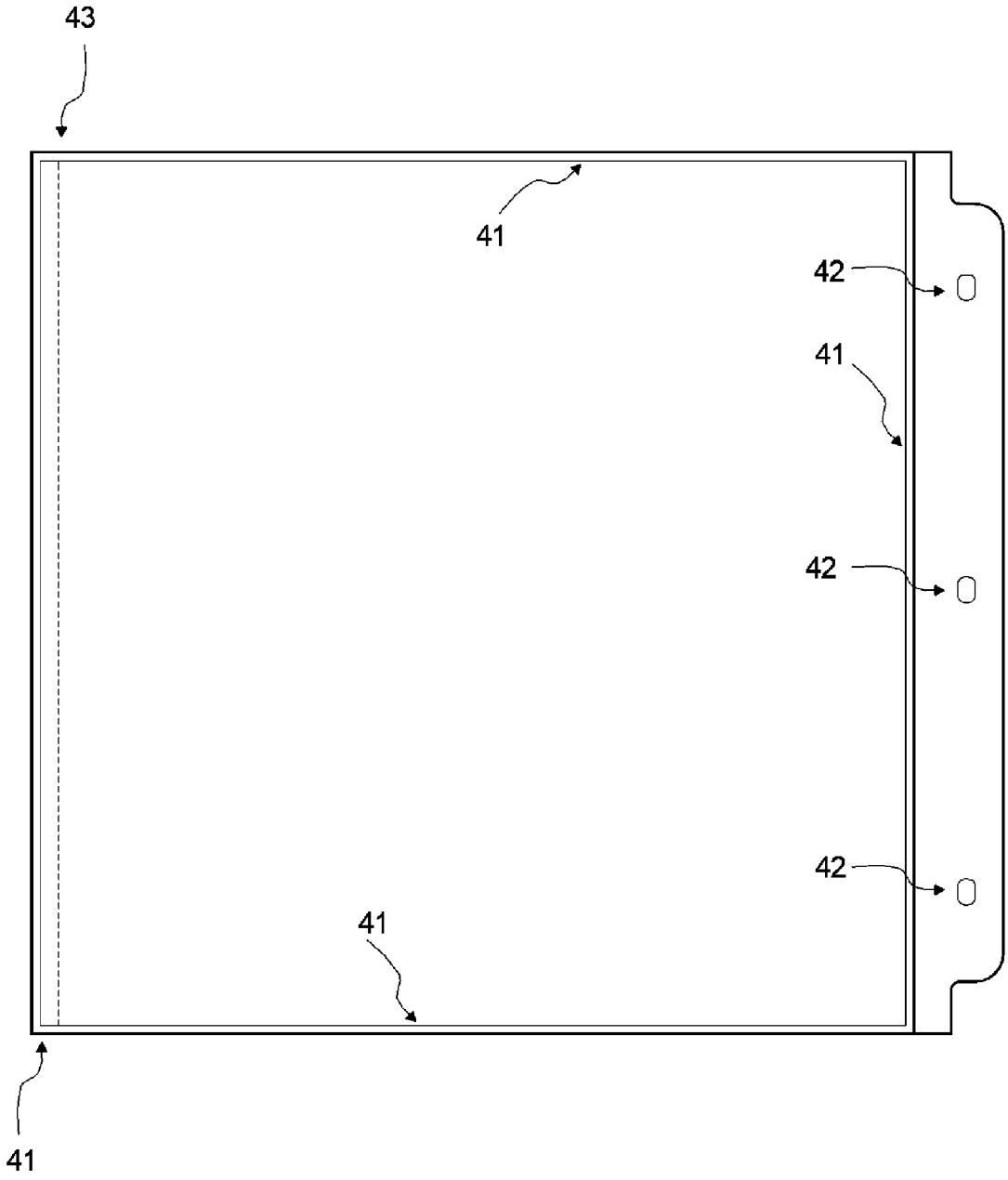
FIG. 4 depicts Embodiment II from the opposite side from that depicted in FIG. 3.

FIG. 4 depicts Embodiment II from the opposite side from that depicted in FIG. 3. The holes 42 are shown. The edges 41 of the approximately square envelope are indicated. The slit 43 is on the opposite side of the leaf, but the location of the slit is indicated with a dashed line.

Figure 10:
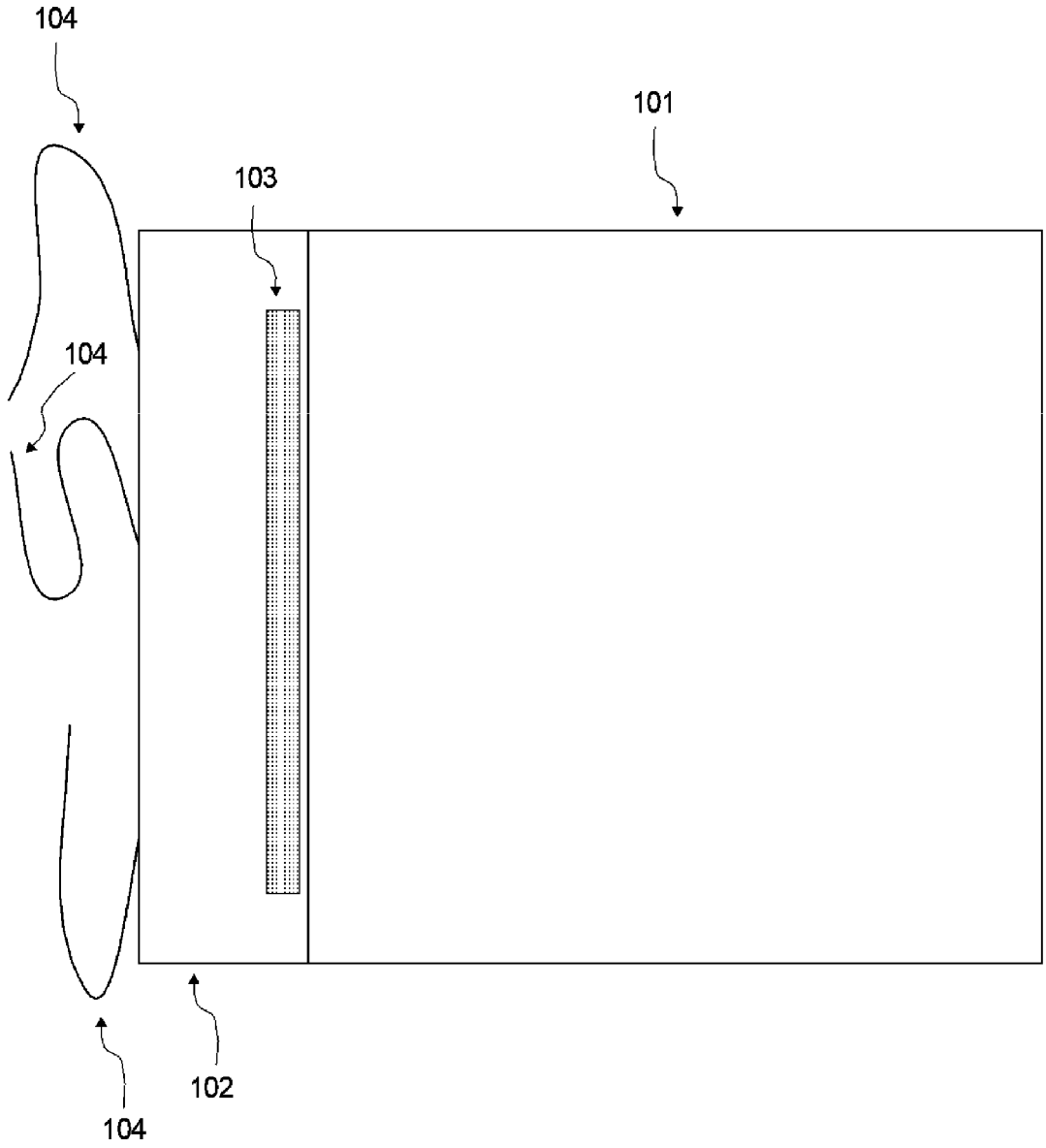
FIG. 10 depicts the back part of the preferred embodiment of the cover component of the invention.

FIG. 10 depicts the back part of the preferred embodiment of the cover component of the invention disclosed here. That part is viewed from the side that would face the leaves. The outermost layer of the body (101, 102) is a vinyl coated fabric. Part 101 of the body is stiff because pasted chipboard (nominally 0.120") is under the cover. That stiff part of the body is essentially square with approximately 33 cm on each edge. Part 102 of the body is flexible. A region 103 of that part is surfaced with the hook member of a hook and loop attachment system. Three leather strips 104 are attached to the other side of the back part of this preferred embodiment. They are shown in this figure extending beyond the edge of the body of the cover. Whether the strips extended beyond to edge and their specific disposition could vary because those strips are flexible.

Figure 11:
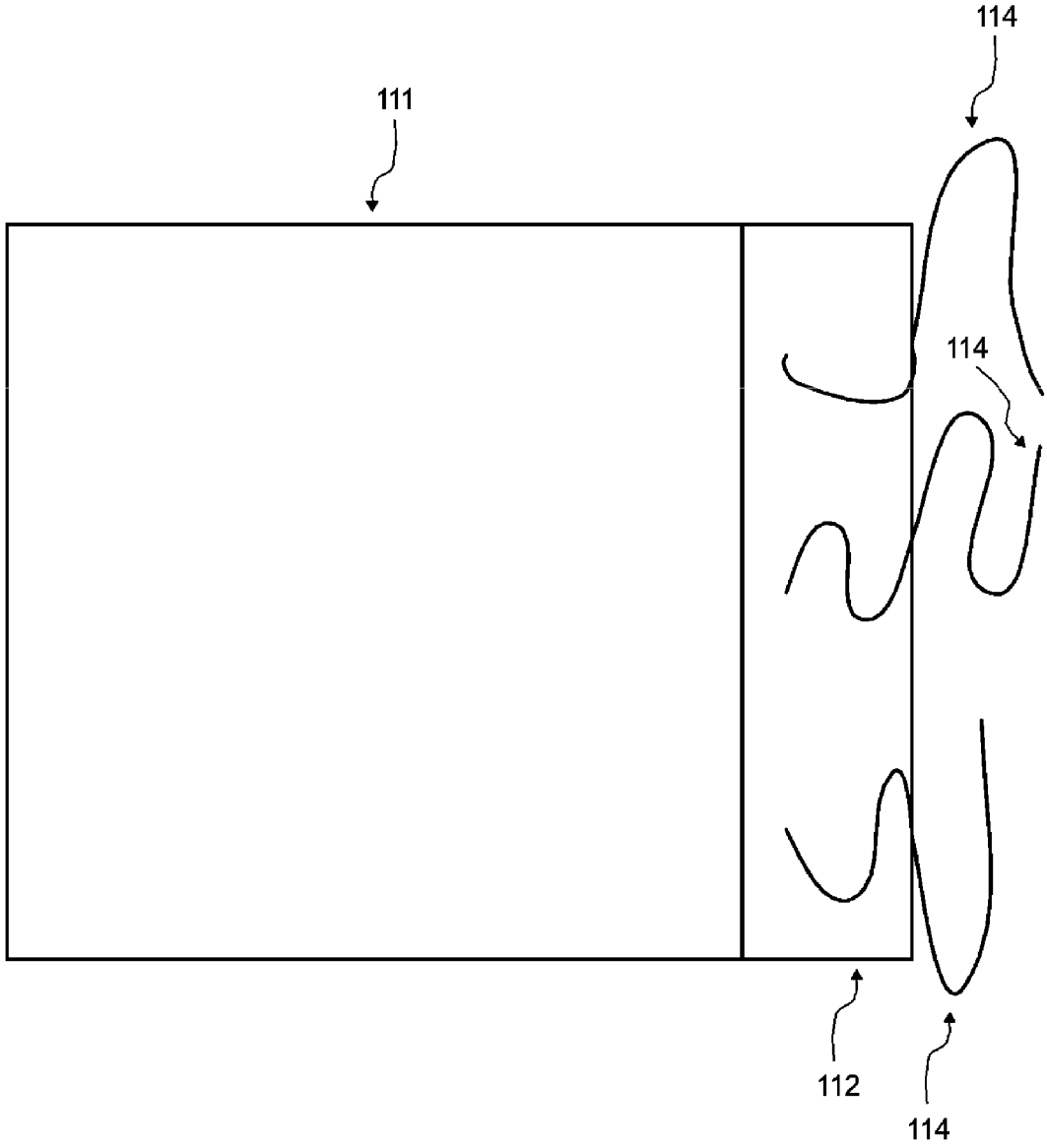
FIG. 11 depicts the opposite side of the back part of the preferred embodiment of the cover component of the invention as that depicted in FIG. 10.

FIG. 11 also depicts the back part of the preferred embodiment of the cover component of the invention disclosed here. That part is viewed from the side that would face away from the leaves. Part 111 of the body is stiff because of the pasted chipboard under the cover. Part 112 of the body is flexible. Three leather strips 114 are attached to this side of the back part of this preferred embodiment. Each strip is attached to the body at one end of that strip. Each strip is approximately 15 cm long. The specific disposition of those strips could vary because those strips are flexible.

Figure 12:
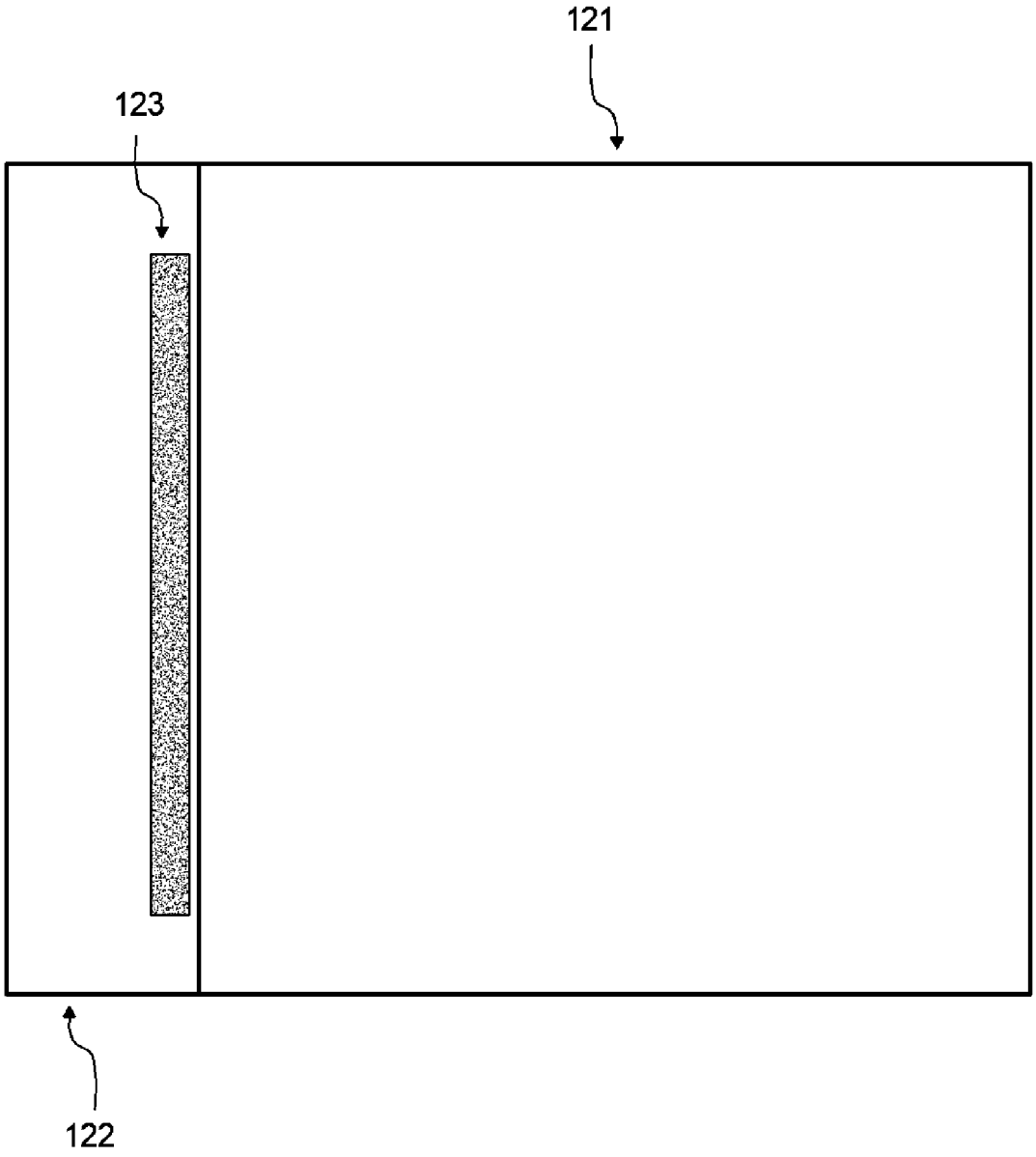
FIG. 12 depicts the front part of the preferred embodiment of the cover component of the invention.

FIG. 12 depicts the back part of the preferred embodiment of the cover component of the invention disclosed here. That part is viewed from the side that would face the leaves. The outermost layer of the body (121, 122) is a vinyl coated fabric. Part 121 of the body is stiff because pasted chipboard (nominally 0.120") is under the cover. That stiff part of the body is essentially square with approximately 33 cm on each edge. Part 122 of the body is flexible. A region 123 of that part is surfaced with the loop member of a hook and loop attachment system.

Figure 13:
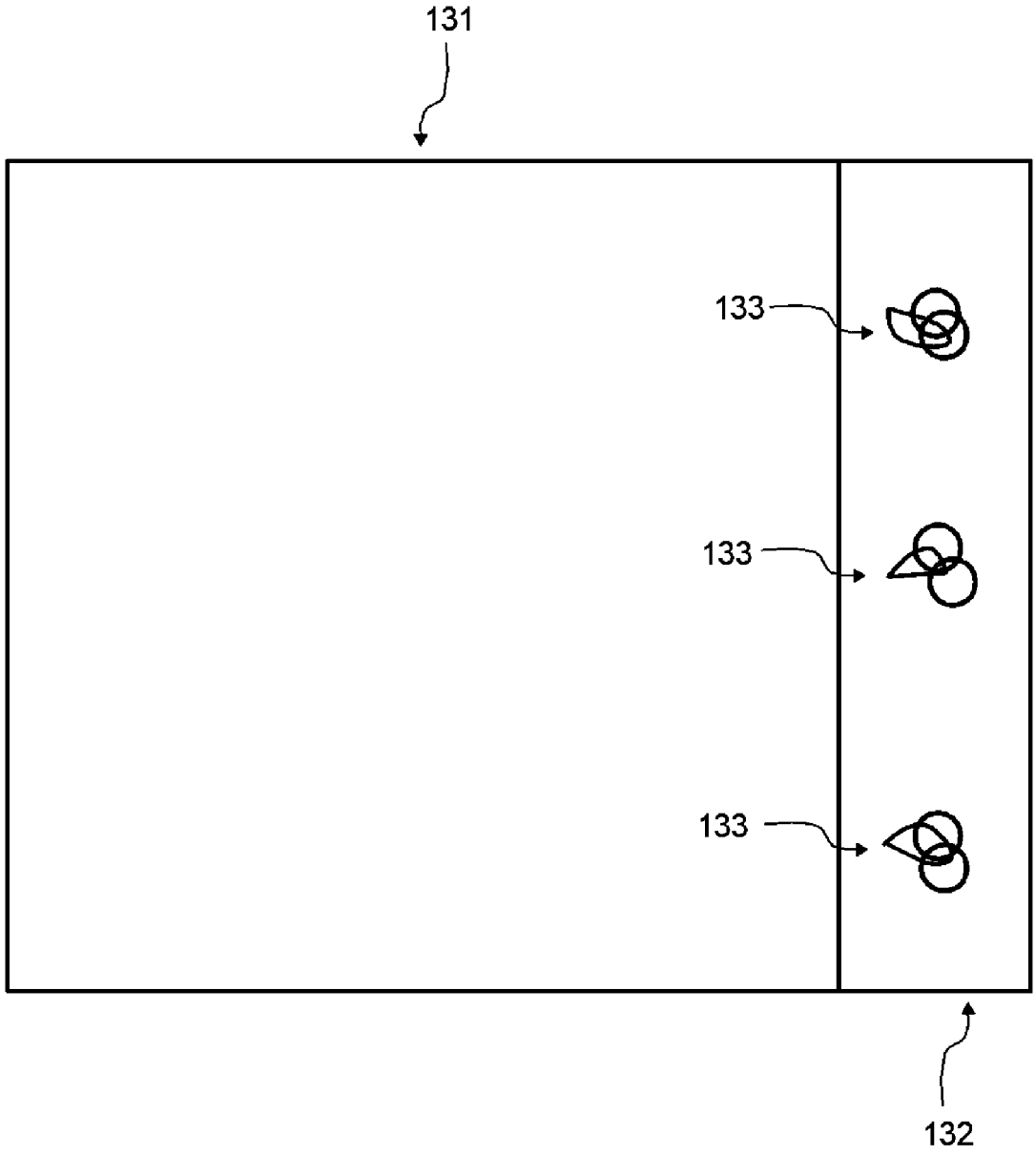
FIG. 13 depicts the opposite side of the front part of the preferred embodiment of the cover component of the invention as that depicted in FIG. 11.

FIG. 13 also depicts the back part of the preferred embodiment of the cover component of the invention disclosed here. That part is viewed from the side that would face away from the leaves. Part 131 of the body is stiff because of the pasted chipboard under the cover. Part 132 of the body is flexible. Three leather strips 133 are attached to this side of the back part of this preferred embodiment. Each strip is attached to the body at both ends of that strip to form a loop. Each leather loop passes through, and thereby secures, two plastic rings. The specific disposition of those loops and rings could vary somewhat since those loops are flexible and the rings are free to move on the loops. Each plastic ring has a radius of approximately 1.8 cm. Each loop would be approximately 6 cm if straightened.

Figure 5:
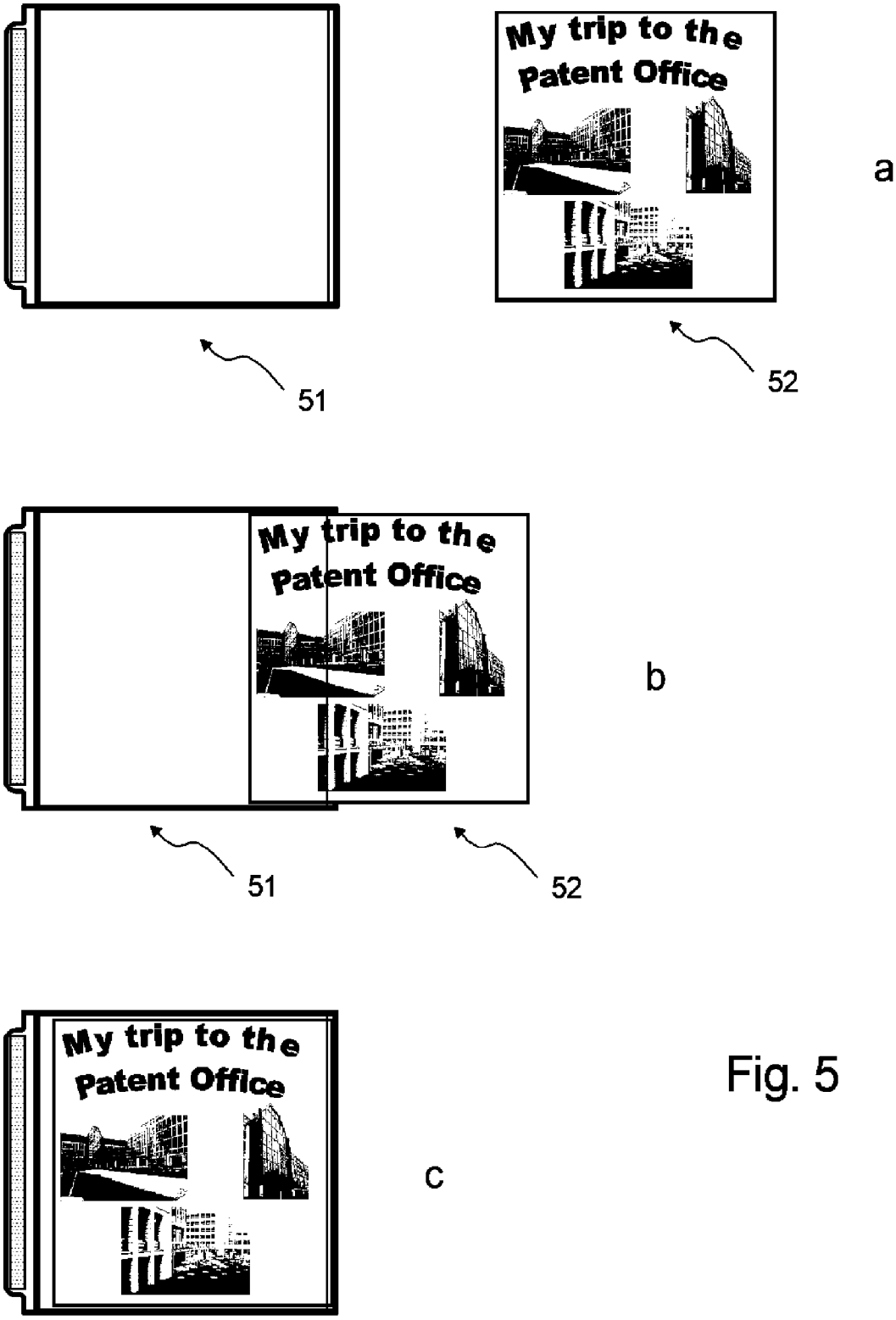
FIG. 5 depicts the placement of a display item into a leaf such as Embodiment I of the leaf component of the invention.

Display items can be housed in Embodiment I or Embodiment II of the leaf component of the invention disclosed here in essentially the same manner. The item to be displayed would preferably be only slightly smaller than the size of the envelope of the leaf. FIG. 5 depicts the placement of a display item into such a leaf. For this illustration, Embodiment II is depicted. View "a" depicts the leaf 51 and the display item 52 before placement of the display item into the leaf. View "b" depicts the display item 52 being past through the slit of the leaf 51. After the display item is slid into the leaf as far as possible the trailing edge of the display item is tucked under the plastic lip on the thin side of the slit. View "c" depicts the display item housed in the leaf.

Figure 6:
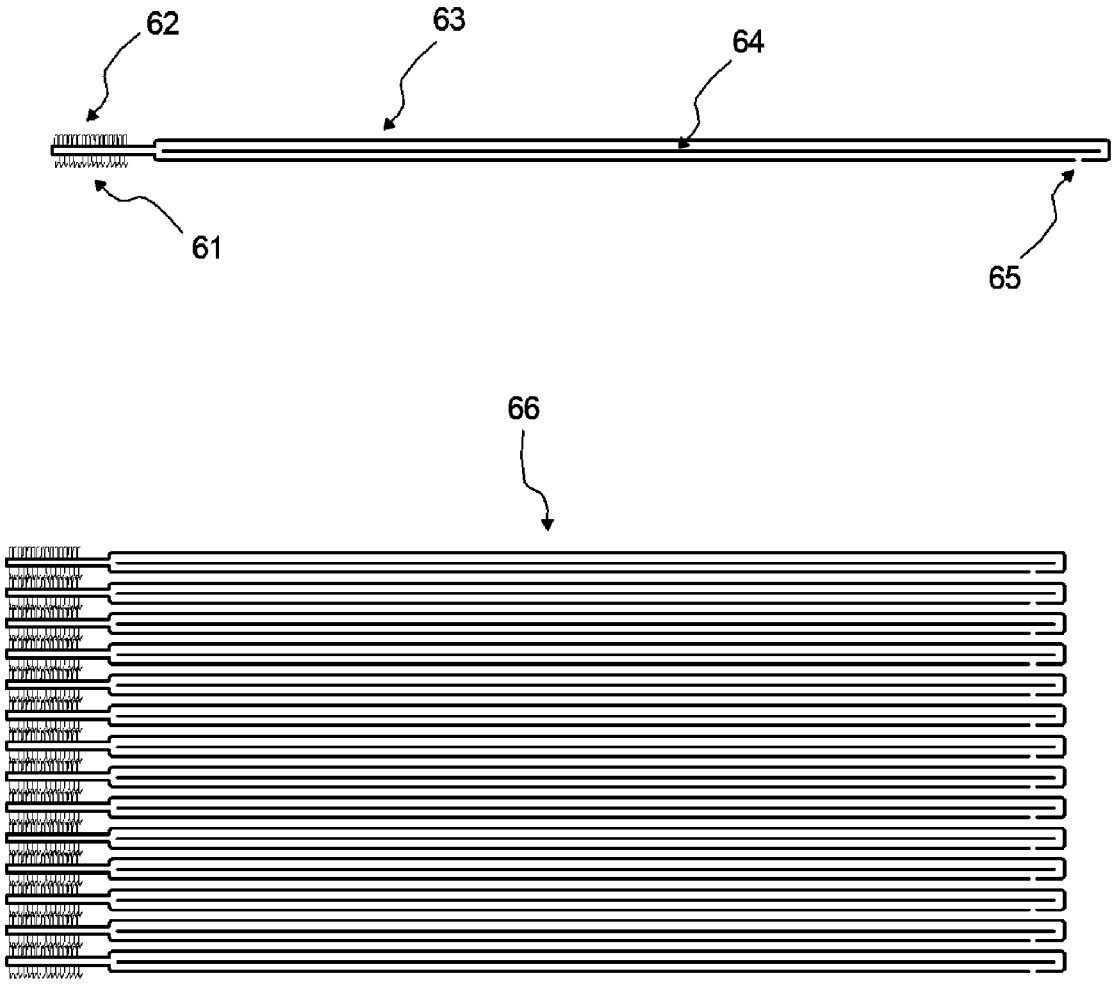
FIG. 6 depicts Embodiment I of the leaf component of this invention in an orientation which is orthogonal to that depicted in FIG. 1.

FIG. 6 depicts Embodiment I of the leaf component of this invention shown in an orientation which is orthogonal to that depicted in FIG. 1. The hook component 61 of the hook and loop attachment system and the loop component 61 of the hook and loop attachment system are shown. The loop component 62 of the hook and loop attachment system and the loop component 61 of the hook and loop attachment system are shown. The envelope 63, slit 65 in the envelope and display item 64 are shown. It is important to note that in the unstressed envelope there is little or no gap between the two edges of the slit. Significant gaps are included in FIG. 6 to make the slits visible on the depiction. Similarly, display items and the leaves would touch, at least in places. The space between the display item and the envelope is merely to make the figure easier to interpret. Multiple leaves can be reversibly attached to each other to form a connected set 66.

Figure 7:
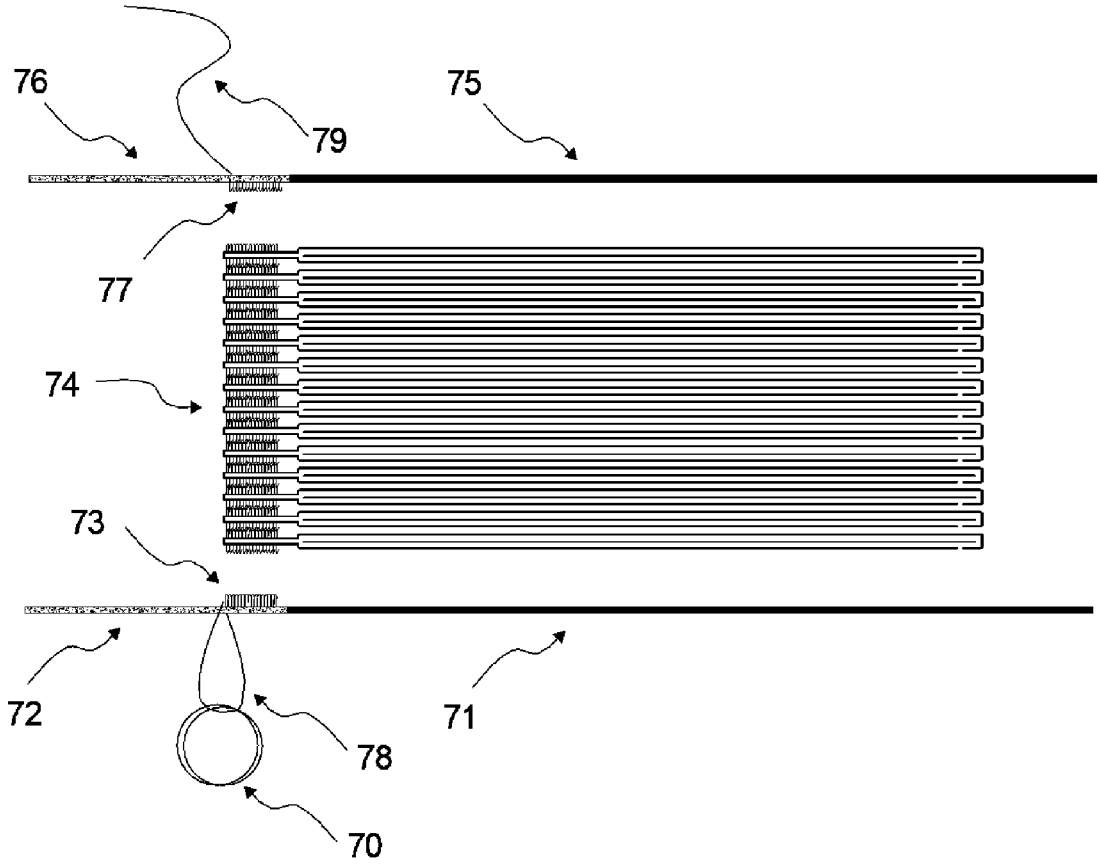
FIG. 7 depicts multiple of Embodiment I leaves attached to each other (essentially as depicted in FIG. 6) in proximity to the preferred embodiment of the cover pieces.

FIG. 7 depicts multiple Embodiment I leaves attached to each other 74 (essentially as shown in FIG. 6) in proximity to the preferred embodiment of the cover pieces. One cover piece includes a stiff portion 75 of the cover body, a flexible portion 76 of the cover body, the hook component 77 of a hook and loop attachment system and leather strips 79. To improve clarity of the figure, only one of the three strips is shown. One cover piece includes a stiff portion 71, a flexible portion 72, the loop member 73 of a hook and loop attachment system, plastic rings 70 and leather loops 78. To improve clarity of the figure, only one of the three loops and one of the three pairs of rings are shown. As depicted, the front of the album is at the bottom of the figure.

Figure 8:
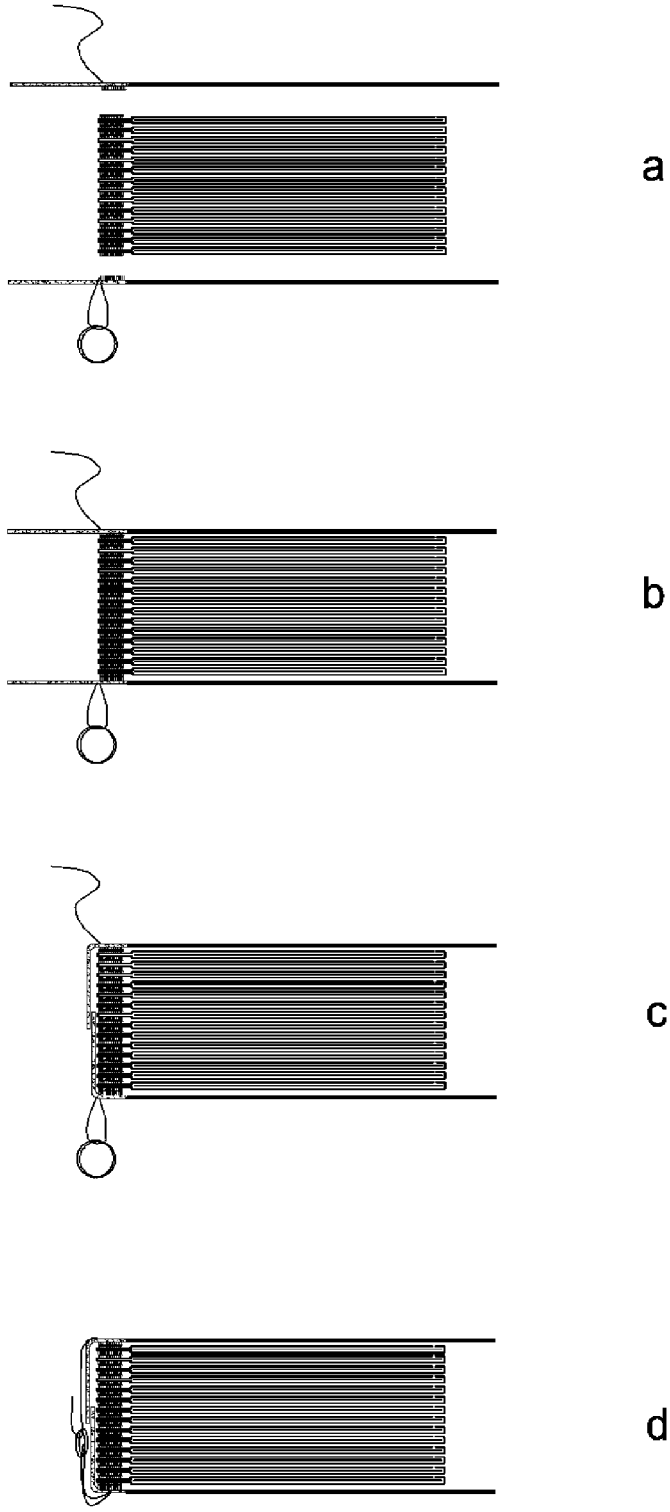
FIG. 8 depicts several views showing the assembly of the system which includes Embodiment I of the leaves and the preferred embodiment of the cover pieces of the invention.

FIG. 8 shows several views showing the assembly of the system which includes Embodiment I of the leaves and the preferred embodiment of the cover pieces of the invention disclosed here. The same components are depicted in each of the four views. Only the conformation and arrangement of the components differs from view to view. The depiction in View "a" is essentially like FIG. 7 except that the reference characters were removed for clarity. View "b" depicts the cover pieces reversibly attached to the leaves which were attached to each other. The cover pieces are attached by the hook and loop attachment systems. View "c" depicts the flexible portions of the covers positioned to overlap each other. View "d" depicts the leather strips and plastic rings used to secure the flexible portion of the covers. For clarity, only one of the three loops, ring and strap sets in shown. As depicted, the front of the album is at the bottom of the figure.

Figure 9:
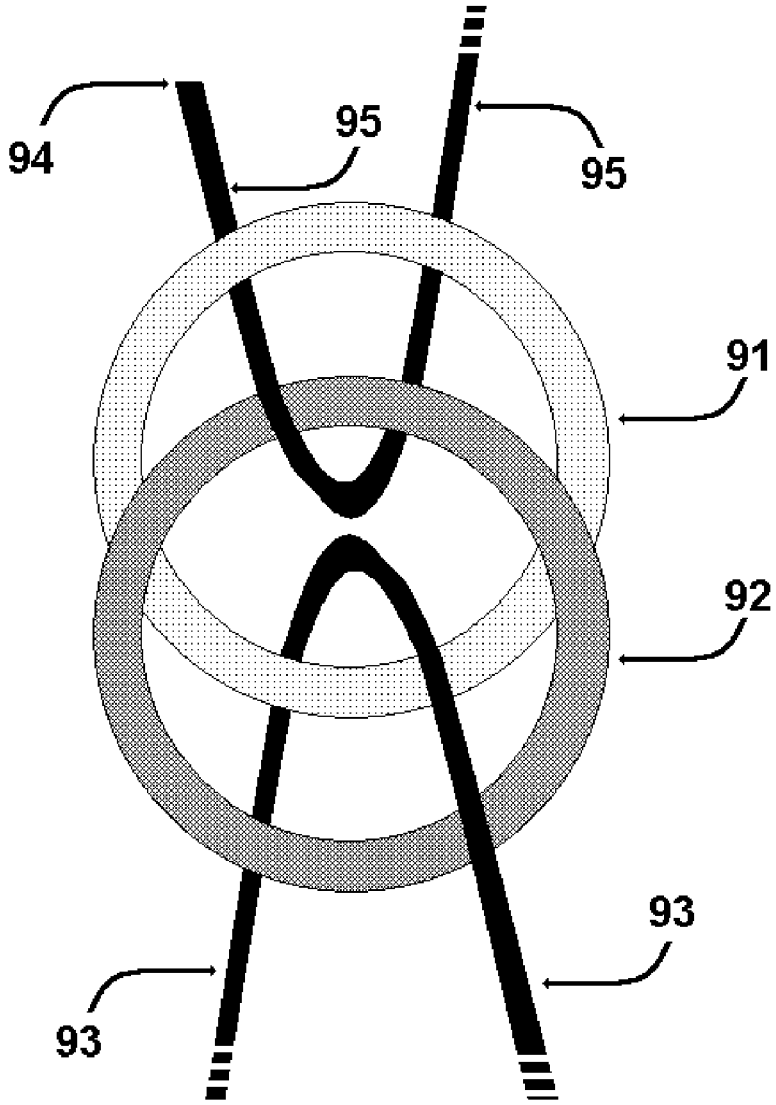
FIG. 9 depicts in detail the arrangement of the rings and strips used to secure the flexible portion of the covers.

FIG. 9 depicts in detail the arrangement of the rings and strips used to secure the flexible portion of the covers. The rings are hatched in two different patterns for easy in viewing. The leather strips are shown in solid black. Each dashed end of a depicted strip indicates continuation of that strip until it attaches to the body of the cover. The rings (91, 92) are secured to one cover by the leather loop 93. The strap 95 is threaded through the rings in the pattern indicated. The free end 94 of that strap is pulled until the system becomes snug.

Embodiment II can be mounted in conventional book-like systems such as three ring loose leaf binders.

Embodiments of the leaves of the invention disclosed here could be made of materials other than polypropylene. The materials of the two sides of the leaf need not be identical. It would be preferable that at least one of the sides of the leaf be transparent. However, for some applications, it would be preferable that one side of the leaf not be transparent. The transparent side made be essentially colorless (as in Embodiment I and Embodiment II) or may be tinted. Embodiments of the leaves of the invention disclosed here could be other sizes and could be rectangles that are not squares. For example, and not by way of limitations, for scrapbooks, squares with sides of approximately 15 cm and approximately 8 cm may also be convenient.

Embodiments of the cover of the invention disclosed here could be made of materials other than those described. For example, and not by way of limitation, the outermost layer of the cover could be a fabric which is not vinyl coated or could be a vinyl material with no fabric component. For another example, and not by way of limitation, portions of the cover could be stiffened by other than pasted chipboard. Embodiments of the cover of the invention disclosed here could be other sizes and could be rectangles that are not squares. For example, and not by way of limitation, for scrapbooks, squares with sides of approximately 17 cm and approximately 10 cm may also be convenient.

Embodiments of the leaves of the invention disclosed here are possible which have holes to facilitate mounting in a book-like binding system, but which have a different number of holes than Embodiment II. It is also possible for the holes to differ in size and shape.

Through this description mention is made of components surfaced with members of hook and loop systems. The preferred method of such surfacing is the use of an adhesive. However, other methods are possible. Those other possibilities include, without limitation, sewing.

Embodiments of the leaf component of the invention disclosed here, including Embodiment I and Embodiment II, are significantly better suited for applications including scrapbooking than are conventional leaves. These embodiments allow the easy insertion and removal of display items from the leaf. That insertion and removal of the display items from the leaf can be readily accomplished in cases in which the leaf is secured within an album and in cases in which the leaf is not secured within an album. One significant advantage of these embodiments over conventional leaves is that the configuration of these embodiments significantly reduces the likelihood of the display items being accidentally spilled from the leaves.

Embodiments of the leaf component of the invention disclosed here, including Embodiment I and Embodiment II, can protect display items from dust and the like better than conventional top-loading leaves. The disposition of the opening in these embodiments makes dust far less likely to enter the leaf. This is especially important because many photo albums, scrapbooks, and the like are retained for very long times.

The embodiments of the leaf component of the invention disclosed here which make use of hook and loop attachment systems to reversibly attach the leaves has several advantages over conventional ways of attaching pages. Beneficial features of these embodiments include the ability to readily insert or remove leaves from any selected position within the collection of leaves. Another beneficial feature is that the leaf is secured along the entire length of the securement region. That decreases the chances of deformation or tearing possible in systems, such as three ring binder systems in which the securing occurs in relatively small areas, causing the stresses in those areas to be more problematic. The securement regions of certain embodiments of the leaf component of the invention disclosed here are significantly thicker than the securement regions conventional leaves. For example, the thickness of a collection of Embodiment I of the leaves is approximately 4 mm per leaf. Since many applications, including many scrapbooks have materials with thicknesses which are similar to that 4 mm, the leaves at opposite ends of a collection (i.e., the first and last leaves) tend to remain nearly parallel to each other as the number of pages changes.

There are embodiments of the leaf component of the invention disclosed here which include components of a hook and loop attachment system but which do not have the slit configuration disclosed here and described as a feature of Embodiment I and Embodiment II.

The preferred embodiment of the album cover system is well suited for covering Embodiment I of the leaf component. This album cover system has the advantage of allowing the adjustment of the spine width as the number of leaves changes. That keeps the album neat in appearance and structurally stable. It allows the front and back covers to be approximately parallel to each other regardless of the number of leaves in the album.

A book-like system which includes the preferred embodiment of the album cover system and Embodiment I of the leaf component has a distinctive, stylish and attractive appearance. The combination of function and aesthetics makes it well suited for many uses, including scrapbooking.

From the above description and drawings, it will be understood by those of ordinary skill in the art that the particular embodiments shown and described are for purpose of illustration only, and are not intended to limit the scope of the invention. Those of ordinary skill in the art will recognize that the invention may be embodied in other specific forms without departing from its spirit or essential characteristics. References to details of particular embodiments are not intended to limit the scope of the claims.

What is claimed is:

1. An album comprising a first album cover component, a second album cover component and a plurality of leaves, in which said first album cover component comprising a stiff portion, a flexible portion, and a flexible strap and rings for attachment to said second album cover component, said first album cover component surfaced in part with a loop member of a hook and loop attachment system, and in which said second album cover component comprising a stiff portion, a flexible portion, and a flexible strap for attachment to said first album cover component, said second album cover component surfaced in part with a hook member of a hook and loop attachment system, and and in which each of the said plurality of leaves is equipped with a securement region, each securement region having a first side and a second side, said first side of said securement region being surfaced, at least in part, with a loop member of a hook and loop attachment system and said second side of said securement system being surfaced, at least in part, with a hook member of a hook and loop attachment system, and in which said leaves each comprise two faces which are attached to each other such that at least one essentially rectangular space is generally enclosed except for a slit in one face, said slit so configured as to allow display items to be reversibly placed into said rectangular space by passage through said slit, said slit situated near, and essentially parallel to, an edge of said essentially rectangular space which is furthest from the securement region.

2. An album as in claim 1, in which saids fittings are rings and said slit is situated between 1 mm and 30 mm from, and essentially parallel to, an edge of said essentially rectangular space which is furthest from the securement region.

3. An album comprising a first album cover component, a second album cover component and a plurality of leaves, in which said first album cover component comprising a stiff portion, a flexible portion, and a flexible strap and rings for attachment to said second album cover component, said first album cover component surfaced in part with a loop member of a hook and loop attachment system, and in which said second album cover component comprising a stiff portion, a flexible portion, and a flexible strap for attachment to said first album cover component, said second album cover component surfaced in part with a hook member of a hook and loop attachment system, and and in which each of the said plurality of leaves is equipped with a securement region, each securement region having a first side and a second side, said first side of said securement region being surfaced, at least in part, with a loop member of a hook and loop attachment system and said second side of said securement system being surfaced, at least in part, with a hook member of a hook and loop attachment system, and in which said leaves each comprise two faces which are attached to each other such that at least one essentially rectangular space is generally enclosed except for a slit in one face, said slit so configured as to allow display items to be reversibly placed into said rectangular space by passage through said slit, said slit situated between 1 mm and 30 mm from, and essentially parallel to, an edge of said essentially rectangular space which is furthest from the securement region.

* * * * *